United States Patent [19]

Tam

[11] 4,105,068

[45] Aug. 8, 1978

[54] APPARATUS FOR PRODUCING OIL AND GAS OFFSHORE

[75] Inventor: William A. Tam, Warrenville, Ill.

[73] Assignee: Chicago Bridge & Iron Company, Oak Brook, Ill.

[21] Appl. No.: 820,169

[22] Filed: Jul. 29, 1977

[51] Int. Cl.[2] ..... E21B 33/035

[52] U.S. Cl. ..... 166/355; 175/7

[58] Field of Search ..... 166/.6, .5; 175/7; 61/95

[56] References Cited

U.S. PATENT DOCUMENTS

| | | | |
|---|---|---|---|
| 3,032,105 | 5/1962 | Reistle, Jr. | 175/7 |
| 3,321,217 | 5/1967 | Ahlstone | 166/.6 |
| 3,419,090 | 12/1968 | Van Dorn | 175/7 |
| 3,675,713 | 7/1972 | Watkins | 166/.6 |
| 3,677,016 | 7/1972 | Garrigus | 61/95 |
| 3,756,293 | 9/1973 | Adler et al. | 61/95 |

*Primary Examiner*—James A. Leppink

*Attorney, Agent, or Firm*—Merriam, Marshall & Bicknell

[57] ABSTRACT

Apparatus for producing oil or gas from an offshore oil or gas well using a production platform near or above sea-level which is laterally and vertically displaceable by the sea and wind and which permits well workover from the production platform, comprising:

a. the following elements of a Christmas tree located at about the seafloor:

a first hydraulic connector joined to the wellhead;

a lower master valve joined to the first hydraulic connector; and a second hydraulic connector joined to the lower master valve;

b. a production tube extending from the second hydraulic connector to the platform and having a valve means accessible from the platform for oil or gas flow regulation, said production tube having a flexible portion which accommodates lateral and vertical movement of the production tube with the platform, and c. a production riser around the production tube and extending from the platform to near the seafloor.

9 Claims, 10 Drawing Figures

APPARATUS FOR PRODUCING OIL AND GAS OFFSHORE

This invention relates to apparatus for producing oil or gas from an offshore well. More particularly, this invention is concerned with apparatus for the production of oil or gas from an offshore production platform near or above sea-level which is laterally and vertically displaceable by the sea and wind.

Oil and gas have been produced from offshore wells for many years using stationary production platforms supported by the seafloor. The customary well casing and production tube extend from the wellhead at the seafloor to the production platform where they are joined to a Christmas tree which provides the necessary valves for safety and oil or gas production control as well as hydraulic connectors needed to attach equipment for wire line well workover.

Stationary offshore production platforms are highly useful in relatively shallow water up to about 100 to 150 feet in depth. In deeper water, and particularly in water over 200, and especially over 300, feet deep stationary platforms are very expensive to build because they must be very large for stability, and they are also difficult to transport to an offshore site and be lowered to the seafloor. In addition, they generally cannot be readily relocated to another offshore site if later this becomes desirable.

Moored floating platforms have been used for deep-water oil production but their use required that the Christmas tree be located at the seafloor wellhead so that oil flow could be controlled if the well production riser and production tube broke as a result of flexing by movement of the platform by wind or sea action. Although this approach permitted control of the oil flow it did not permit ready well workover, such as by means of conventional wire line tools. However, expensive deep-sea diver or submarine installation were involved. Also, well maintenance or workover with pump down tools was quite difficult and so difficult in many cases that wells have been plugged and abandoned rather than worked over.

In the past few years much interest has been shown in articulated tower structures for offshore oil or gas production in deep water. Such structures have a base which rests on the seafloor and a tower joined at its bottom to the base by a universal joint or other swivel joint. See the U.S. Pat. Nos. of Garrigus 3,677,016 and Kouka 3,756,033. When such structures are intended for oil or gas production, as distinguished from well drilling, the Christmas tree has been placed at the wellhead or on the tower production platform. The movement of the tower by sea and wind action can cause flexing of the production tubing and if it breaks an oil spill or gas leak will result when the Christmas tree is located on the production platform. Putting the Christmas tree at the wellhead is expensive and difficult to service and thus it is desired to avoid putting it there even though a break in the production tubing can be controlled by valving off the well.

The described deficiencies of the prior art are largely overcome according to the invention which provides apparatus for producing oil or gas from an offshore well using a production platform near or above sea-level which is laterally and vertically displaceable by the sea and wind and which permits well workover from the production platform, comprising: (a) the following elements of a Christmas tree located at about the sea floor: a first hydraulic connector joined to the wellhead; a lower master valve joined to the first hydraulic connector; and a second hydraulic connector joined to the lower master valve; (b) a production tube extending from the second hydraulic connector to the platform and having a valve means accessible from the platform for oil or gas flow regulation, said production tube having a flexible portion which accommodates lateral and vertical movement of the production tube with the platform, and (c) a production riser around the production tube and extending from the platform to near the seafloor.

The production platform may be floating or be part of an articulated offshore tower, a guyed tower or a tension legged platform. The selection will depend upon the water depth, the drilling program and environmental conditions.

The apparatus of the invention can also include an annulus tube extending from the second hydraulic connector to the platform, with the annulus tube having a flexible portion which accommodates lateral and vertical movement of the annulus tube with the platform. The annulus tube would normally be located in the production riser.

It is further advantageous for the valve means which is accessible from the platform to be a dual master valve, and to also include a vertical conduit which extends upwardly from the valve means and is joined to a swab valve, and to close the swab valve with a tree cap.

In a particularly useful embodiment of the invention the platform is mounted on a buoyant articulated tower. In addition, a motion compensating means can be included to stabilize the platform against movement and to tension the flexible portion of the production tube for well workover.

The invention will be described further in conjunction with the attached drawings, in which.

So far as is practical, the same parts or elements which appear in the different views of the drawings will be identified by the same numbers.

Figure 1:
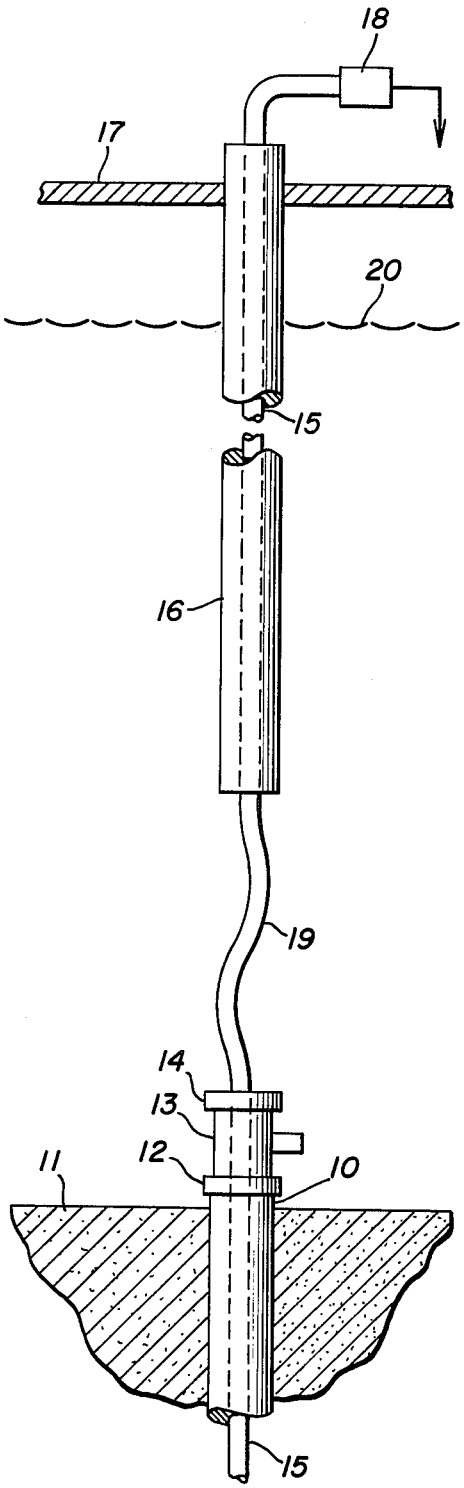
FIG. 1 is an elevational view, partially broken away, of an apparatus according to the invention in which a production tube with a flexible portion extends from a wellhead at the seafloor to a production platform, and the production tube has valve means both at the seafloor and also at, or accessible from, the platform.

With reference to the drawings, FIG. 1 illustrates one aspect of the invention in its broad form. A sub-sea wellhead 10 is located at the sea floor 11. Conventional drilling rigs may be used to drill the well and to install the wellhead. Joined to the wellhead 10 is a hydraulic connector 12, a lower master valve 13 and a hydraulic connector 14. Production tubing 15 extends upwardly from the well through the wellhead, lower master valve and production riser 16 to production platform 17 where it is joined to an oil or gas flow control means 18 which may comprise, in one form of the invention, a production choke. The oil or gas leaving the control means 18 is then delivered to any suitable location for further handling. The production platform 17 may be mounted above sea-level 20 as part of an articulated offshore tower or be part of a floating deck on a ship, or be supported by a guyed tower or tension legged tower.

The production tube 15 has a flexible portion 19 between the end of production riser 16 and hydraulic connector 14. This flexible portion accommodates the lateral and vertical movement of the production tube with the production platform 17 movement caused either by sea currents, waves or by the effect of wind.

The apparatus as illustrated by FIG. 1 and described above will be seen to place an essential but minimum amount of safety equipment at the wellhead on the seafloor and to simultaneously permit the location of the remaining part of the Christmas tree and any oil or gas production apparatus on a production platform which is subject to lateral and vertical movement. Such movement can be accepted without failure of the equipment because of the flexible portion in the production tube. The FIG. 1 illustrated version of the invention thus clearly shows how splitting a Christmas tree permits use of an articulated tower or equivalent structure for offshore oil or gas production. The invention furthermore makes it possible to achieve wire line well workover using equipment conventionally employed for that purpose. When a Christmas tree is entirely placed at the seafloor wellhead according to prior art systems, one could not readily do a wire line well workover. Instead, such workovers had to be achieved by means of pump-down well workover equipment which is difficult to handle successfully in deep water.

Figure 2:
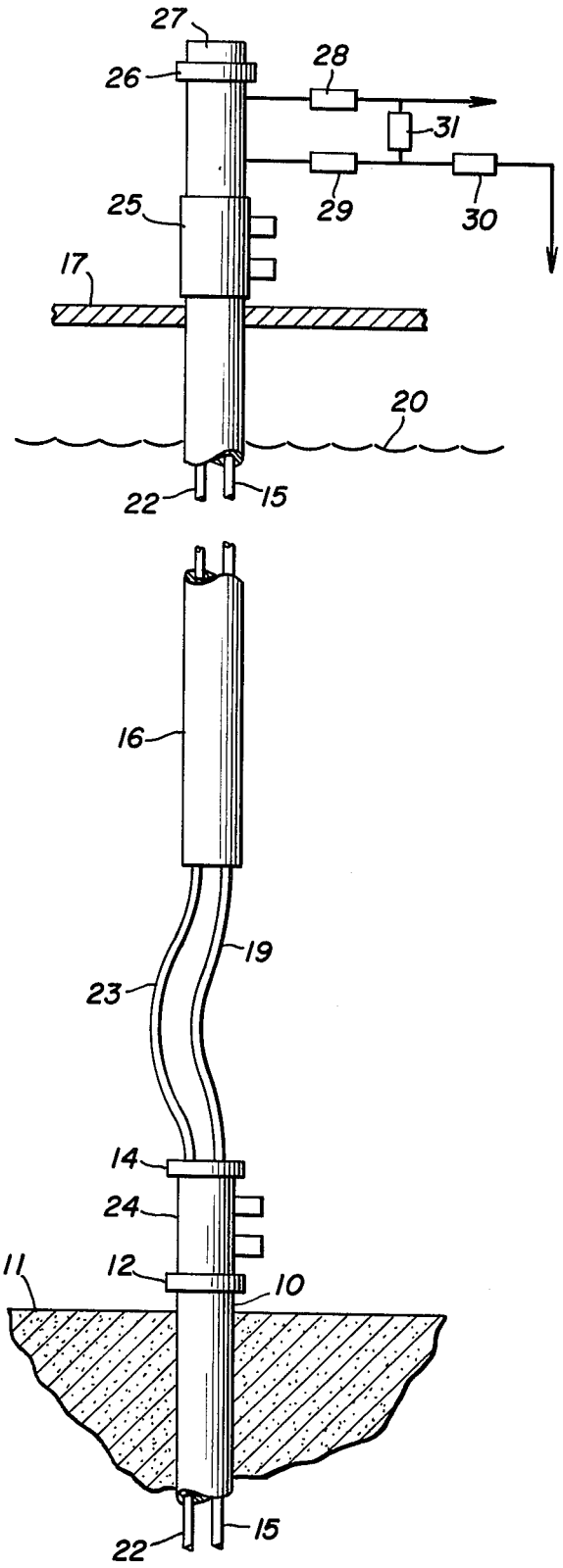
FIG. 2 is an elevational view, partially broken away, which is similar to FIG. 1 but which shows an annulus tube in the production riser and additional valve means at the wellhead and at the production platform.

FIG. 2 illustrates another version of the invention which employs additional valving for greater flexiblity of operation. However, those parts of the apparatus which are similar in FIGS. 1 and 2 will not be described again. As shown in FIG. 2, annulus tube 22 extends from the wellhead 10 through the production riser 16. The annulus tube has a flexible portion 23 to accommodate lateral and vertical movement of the production platform 17. A dual lower master valve 24 is positioned between hydraulic connectors 12 and 14 on the wellhead at the seafloor. A dual upper master valve 25 is positioned to be accessible from the production platform 17. By means of the lower master valve 24 and the upper master valve 25 control of the annulus tube and of the production tube 15 is readily achieved at each valve location. Located above the dual upper master valve 25 is swab valve 26 which is then topped by a tree cap 26. Wing valve 28 is positioned in an extension of the annulus tube 22 from which the annulus continues on to an annulus manifold which is not illustrated. Similarly, wing valve 29 is positioned in an extension of the production tube 15. The production tube extends from wing valve 29 to a production choke 30 from which the production tube travels to a production manifold or to some other suitable location. If desired, a crossover valve 31 may be positioned to direct flow between the annulus tube and the production tube in case this becomes advantageous.

FIGS. 3 to 10 of the drawings illustrate further aspects and embodiments of the invention but are intended primarily to show how the apparatus of the invention may be installed offshore and employed for oil or gas production and used for wire line well workover.

Figure 3:
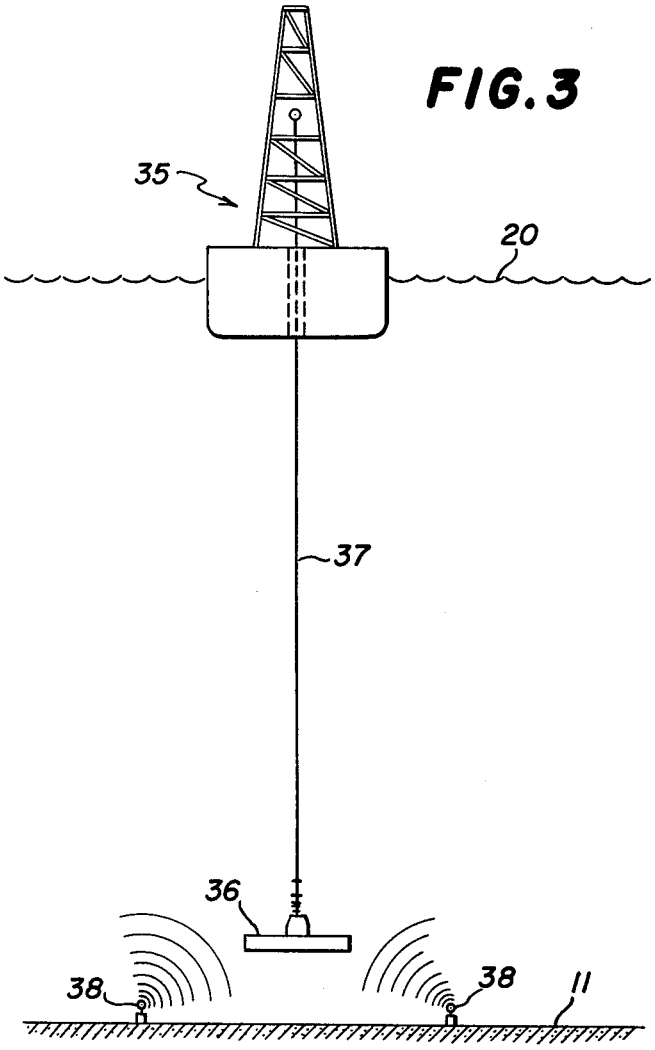
FIG. 3 is a schematic elevational view showing the positioning of a seafloor template by means of a drilling vessel.
Figure 4:
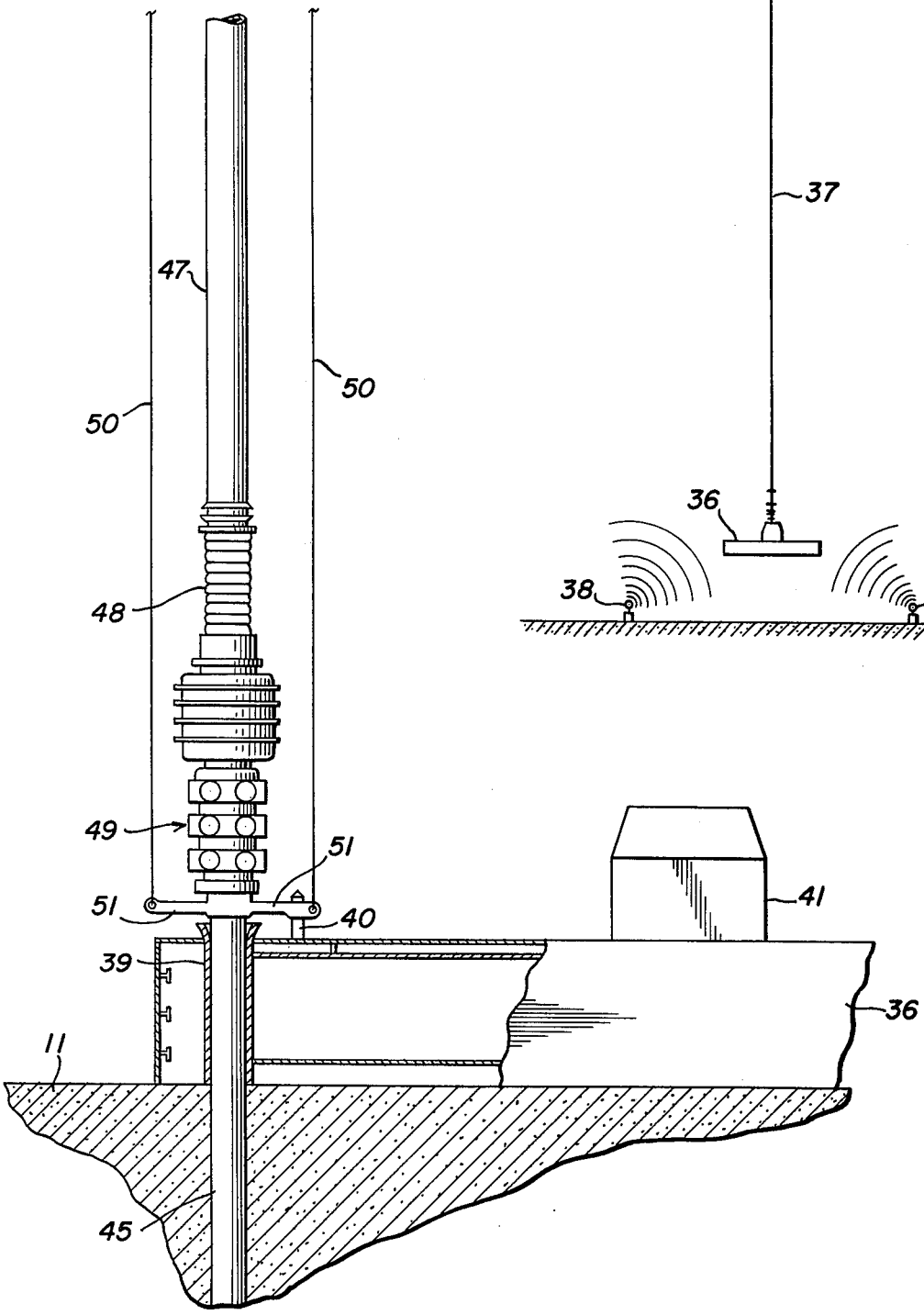
FIG. 4 is an elevational view, partially in section, of one part of the seafloor template showing a well being drilled from a floating drilling rig.
Figure 5:
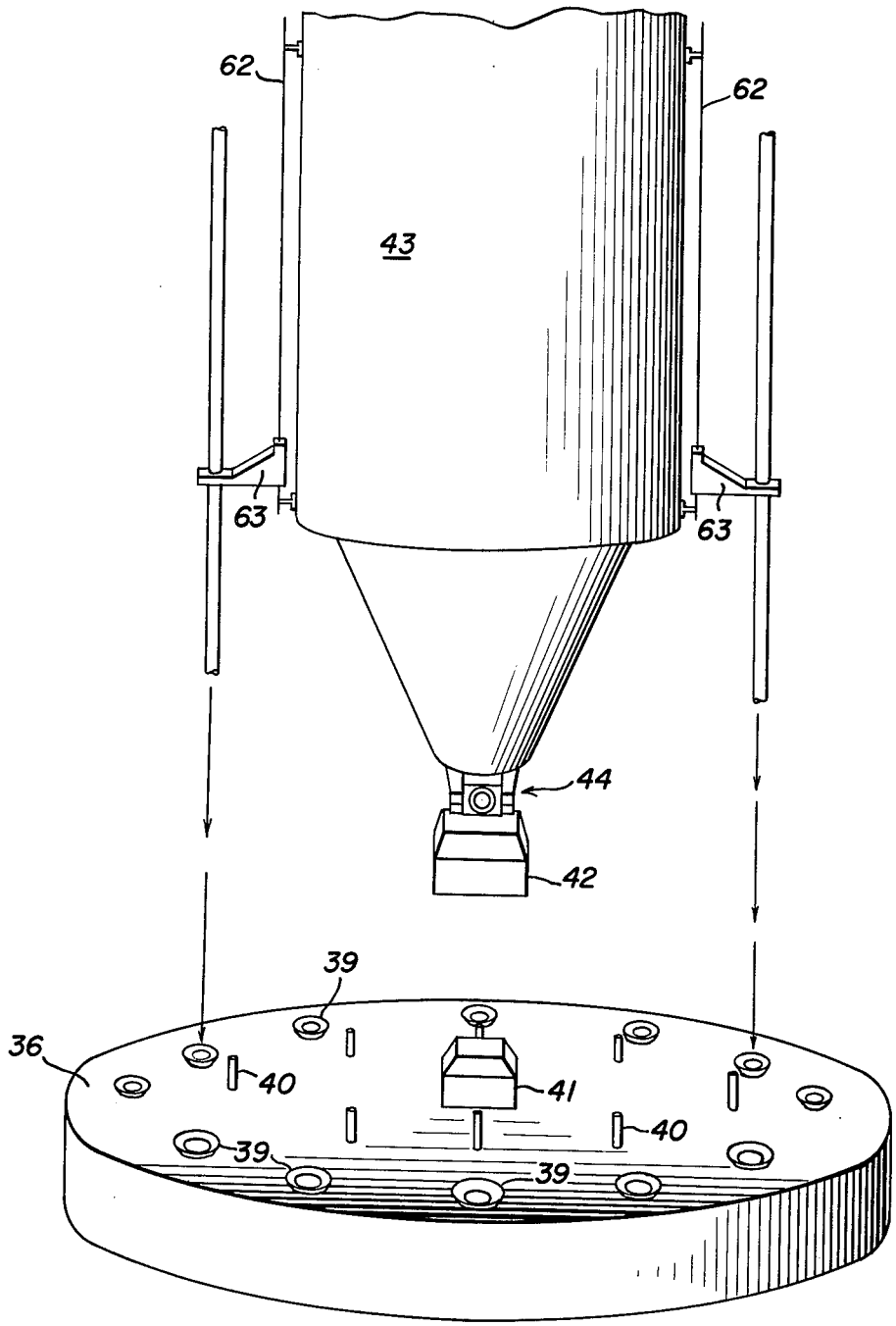
FIG. 5 is an isometric view showing the seafloor template and the lower part of an articulated tower to be joined thereto.
Figure 6:
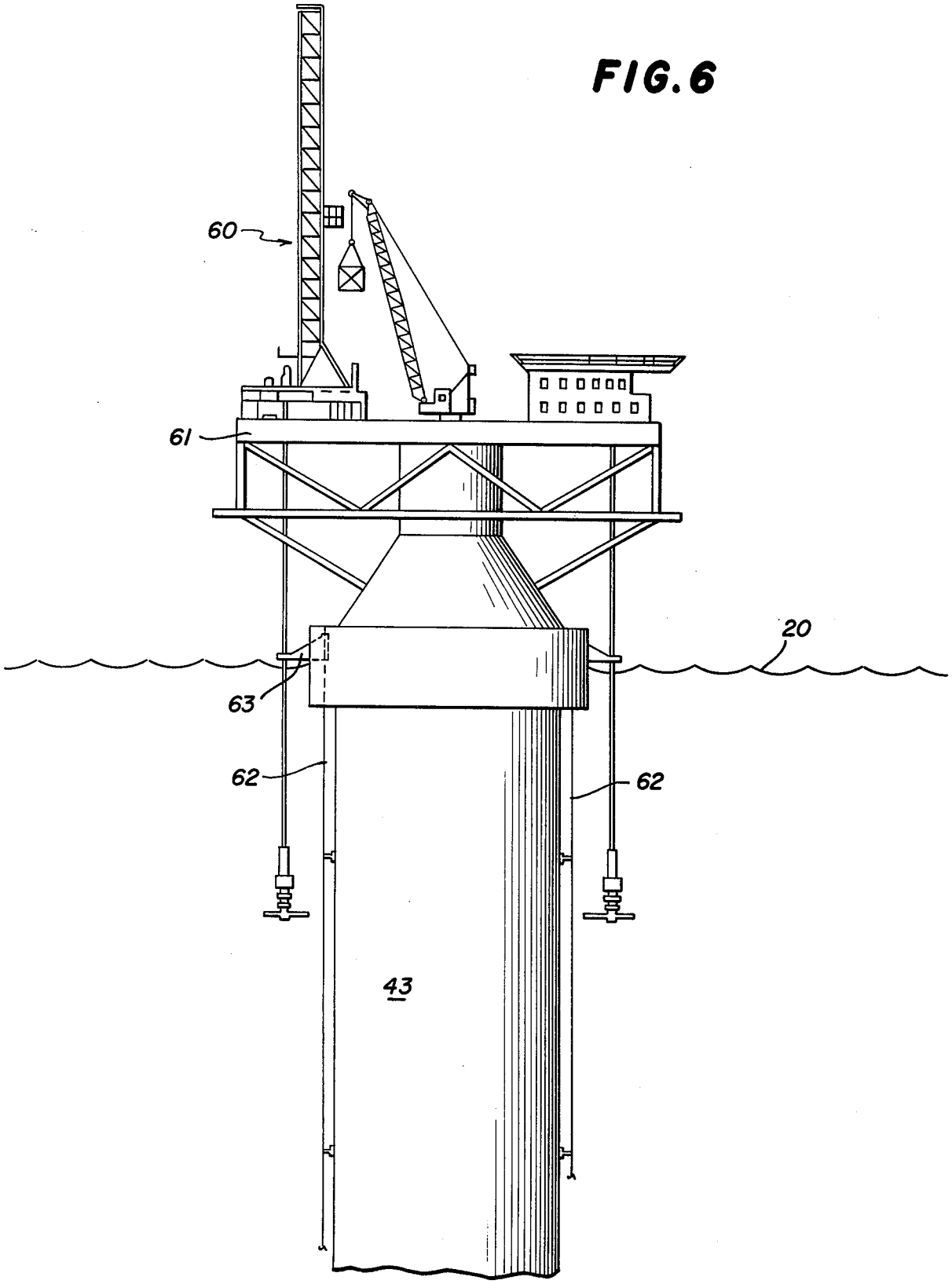
FIG. 6 is an elevational view of the top part of the articulated tower and shows the production platform.

In FIG. 3 there is shown a drilling vessel 35 being used to lower a seafloor template 31 to the seafloor by means of drill string 37. Transponders 38 are used to guide the template 36 to the desired seafloor location. As shown in FIG. 5, the seafloor template 36, which would be constructed mainly of steel, includes well guides 39 which constitute tubular sleeves extending through the template, and guide pins 40 for remotely positioning equipment thereon. Socket 41 is also positioned on the top of template 36. It is used to join buoyant articulated tower 43 to the template by means of a mating connector 42 which extends downwardly from a universal joint 44 at the lower end of the tower.

A well is drilled through each of the well guides 39 in the template 36 using a floating rig such as a drill ship or a semi-submersible. A blow-out preventer (B.O.P.) stack is positioned over each of the subsea wellheads using guidelines from the floating vessel 35 and the B.O.P. stack 49 is landed on the subsea wellhead by means of guidelines 50 and the guide system comprising arms 51 and guide pins 40. The marine drilling riser 47 has a flexible joint 48 to accommodate the motion of the drill ship. After the drilling program has been completed the production casing 45 is run and cemented in and the well plugged back. The drill ship then proceeds to the next well location and the operation is repeated. The buoyant articulated tower 43 is then mated to the seafloor template by means of socket 41 and connector 42 as shown in FIGS. 5 and 7.

Figure 7:
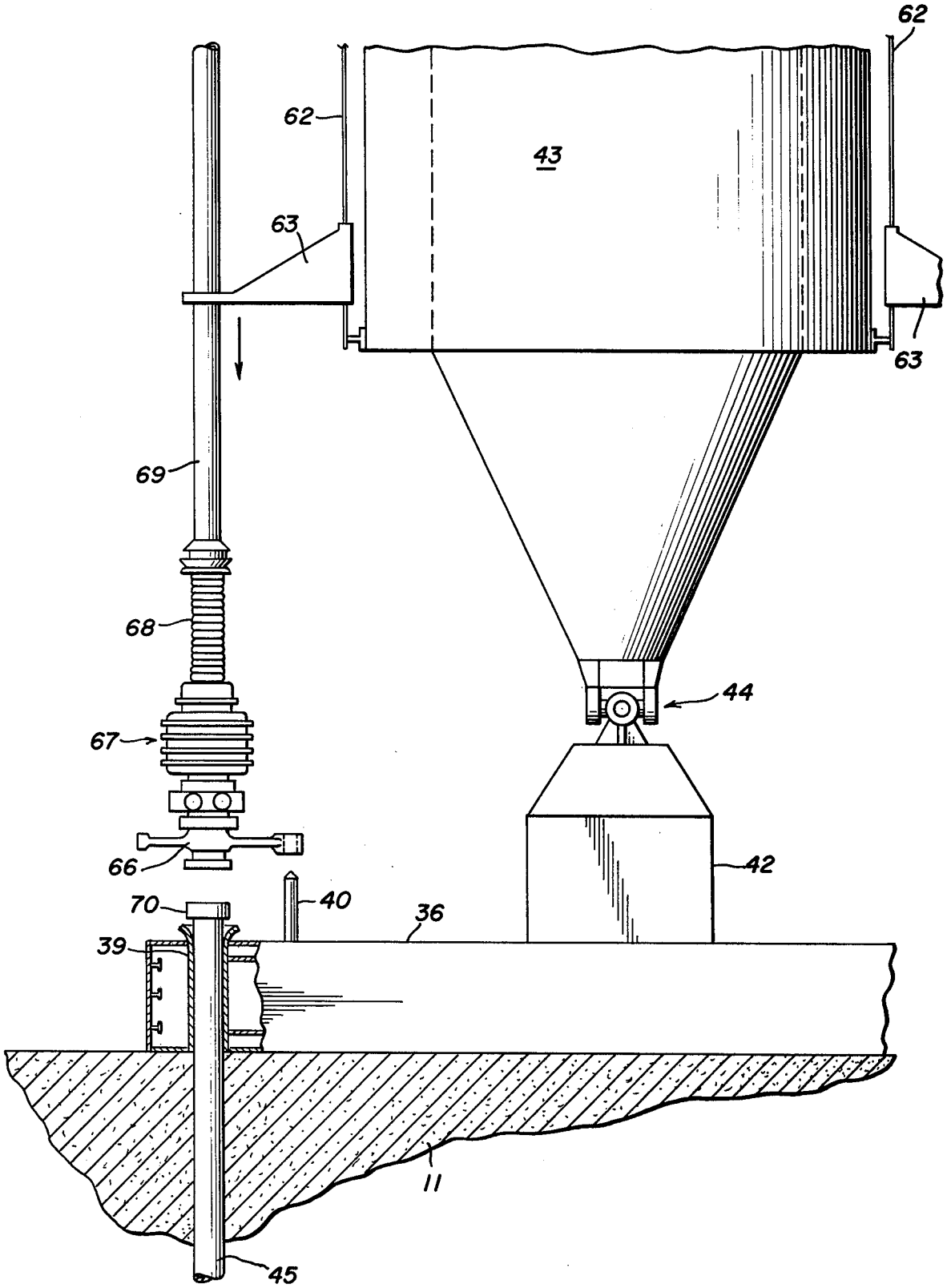
FIG. 7 is an elevational view, partially in section, showing the lower end of the articulated tower and a production riser having a well completion blow-out prevention (B.O.P.) stack at the end thereof.

After the buoyant articulated tower 43 is joined to the seafloor template as shown in FIGS. 5 and 7, a well completion, well workover rig 60, is positioned on the production platform 61 supported by tower 43. The tower 43 has a series of vertical rails 62 on which moveable guides 63 are located. Well completion is accomplished by attaching a guide base 66 to the bottom of a well completion blow-out preventor (B.O.P.) stack 67 which in turn is attached to flexible connection 68 at the end of a riser 69. Riser 69 is controllably lowered by means of guide 63 to position the guide base 66 on guide pin 40 over the wellhead 70. After the well completion B.O.P. stack is so positioned plugs in the production casing 45 are drilled out and the casing perforated. The production tubing and packer system is then installed in the well and the tubing is tested and plugged. Following that, the well completion B.O.P. stack and riser system are removed and the well is left for potential production in the future.

Figure 8:
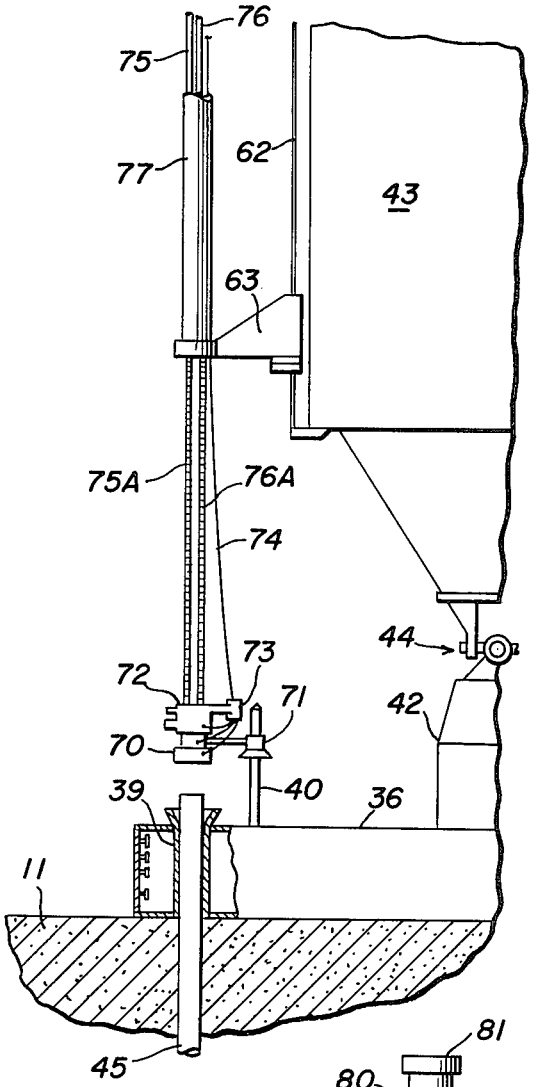
FIG. 8 is an elevational view showing part of the lower end of the articulated tower and the installation of a portion of the Christmas tree at the seafloor.
Figure 9:
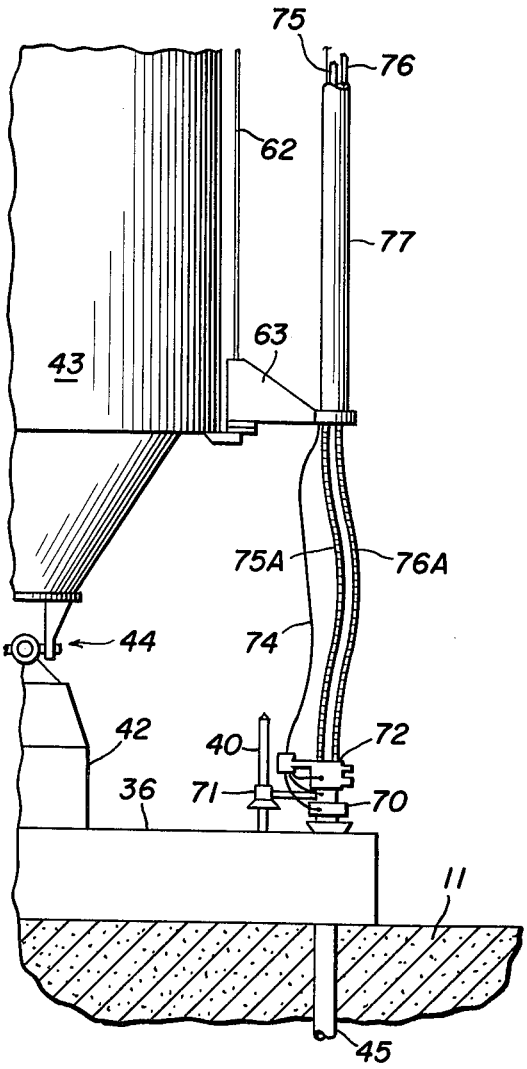
FIG. 9 is an elevational view of part of the lower portion of the articulated tower and shows the apparatus during oil or gas production.
Figure 10:
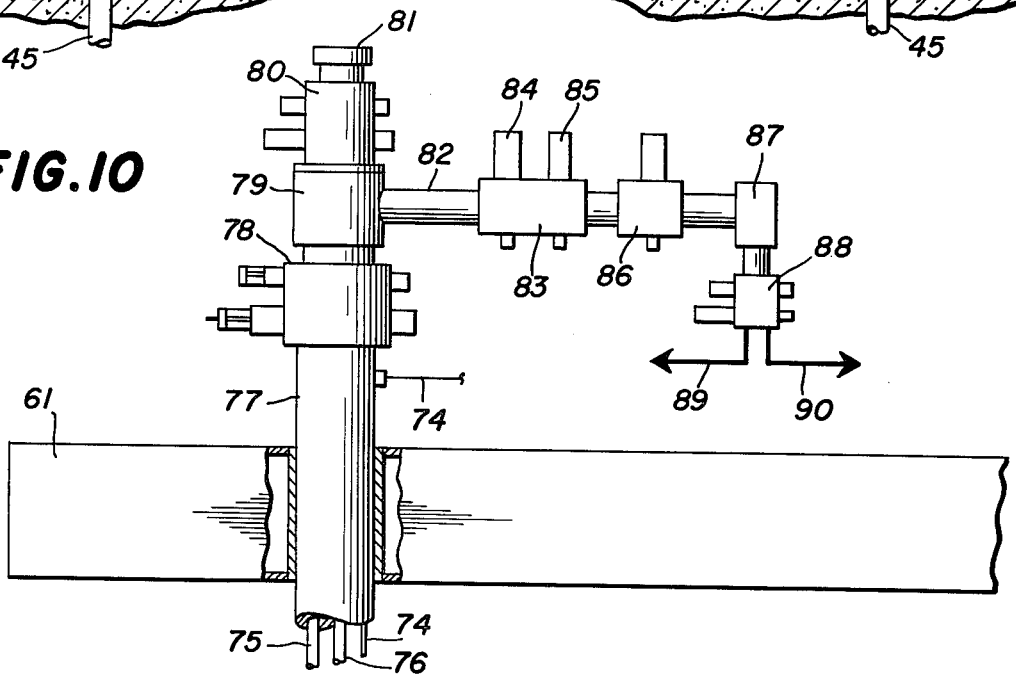
FIG. 10 is an elevational view of the production platform showing the above-sea portion of the Christmas tree associated with the platform and accessible therefrom.

FIGS. 8 to 10 illustrate operations which can be followed to put the well into production.

Hydraulic connector 70 has connected to it a guide member 71 which fits over guide pin 40. A dual lower master valve 72 is joined to hydraulic connector 70 and guide member 71. The hydraulic pod 73 is associated with the lower master valve 72 and hydraulic control line 74 extends from the hydraulic pod 73 up to the production platform 61. Annulus tube 75 and production tube 76 are joined at their lower ends to the lower master valve 73, and they extend upwardly through production riser 77 which extends up to and above production platform 61. The annulus tube and the production tube have respectively flexible portions 75A and 76A to accommodate the flexing which is caused by movement of the articulated tower 43. The production riser 77 is joined at its lower end to guide 63 which is moveably positioned on guide rail 62. By lowering the production riser 77 using such a guide system the hydraulic connector 70 is positioned on the top of production casing 45 and is secured thereto as shown in FIG. 9. In this way, the lower part of the Christmas tree is positioned at the wellhead adjacent the seafloor. After these operations are completed, the upper part of the Christmas tree can be installed as shown in FIG. 10. Dual upper master valve 78 is connected to the top of production riser 77. A T-connection 79 is placed on top of the upper master valve 78 and on top of that connection is located a swab valve block 80 which is plugged by a tree cap 81. The hydraulic line 74 extends out of production riser 77 and continues to a well control panel. A tube 82 extends from T-connection 79 to a block 83 containing wing valves 84 and 85 for controlling flow in the annulus tube and the production tube. Cross-over valve 86 provides for flow to and from the annulus tube and the production tube. Production choke 87 is positioned in the production tube to regulate oil or gas flow. Flow line valve 88 communicates with the production choke and from it conduit 89 leads to an annulus manifold and conduit 90 leads to a production manifold. Further arrangement of such valving and the like may be employed and for this reason the structural elements are described in a conventional way since their use in operation is well understood by those skilled in this art. Once the above-sea portion of the Christmas tree is installed as described the system is tested. After that the well is ready to be put into production.

The well may be put into production by using conventional wire line equipment run through the tree swab valve 80 and through the upper master valve 78, through the lower master valve and into the well itself to unplug the plugged production tubing. After that the master valves are closed and the production riser is lowered an additional specified distance to allow for the anticipated tower motion. The guide frame 63 is then locked into position on the rail 62. This provides allowance for the flexible portions 75A and 76A to bend with movement of the tower. The well is then ready for production of oil or gas.

One of the major advantages of the described systems is that they permit wire line workovers using existing wire line tools and techniques. Normal wire line workovers can be accomplished from the production platform 61 by first closing production choke and swab valves. The production tube and annulus tube can then be disconnected from the manifold. The guide 63 may then be unlocked from the rail 62. The production riser 77 may then be raised to remove the slack in the flexible portions 75A and 76A of the production and annulus tubes. The wire line equipment is then run through the tree swab valve 80 and the operation is continued until the wire line workover is completed. At that time the described procedures are reversed to put the well back into production. In this way individual wells can be worked over without interfering with the production of other wells on a production manifold. It furthermore permits major workovers such as removing the producting tube, drilling further into the reservoir, perforating or acidizing without stopping production on any adjacent wells.

For a major workover the slack in flexible portions 75A and 76A is first removed and then the well is killed by circulating mud through the annulus or by forcing mud into the reservoir. Once the well has been killed plugs are installed with a wire line in the production and annulus tubes immediately below the lower master valve. After that the upper portion of the Christmas tree can be removed, the wellhead connector hydraulicly disconnected and the lower master valve assembly retrieved. A guide base may then be run down on the guide and oriented over the well. A workover B.O.P. stack and riser can then be run down and hydraulicly connected to the wellhead and tested. The down hole tubing plugs can then be removed and the production tubing pulled and the packers removed. At that time the major workover activity can be performed and upon completion the packers and tubing can be re-run and set. The production tube and annulus tube can then be plugged immediately below the topmost casing hanger using wire line techniques. The workover B.O.P. stack can be removed and the lower master valve and annulus tube and production tubes with their flexible portions can be re-installed as previously described.

In addition to the wire line workover capability possessed by the apparatus of this invention, it also has the additional advantage of having the major portion of the Christmas tree above sea-level on or accessible from the production platform where it can be readily reached by operators. At the same time, however, the lower master valve at the seafloor provides the necessary safety against environmental damage through an oil or gas blow-out of the well.

The foregoing detailed description has been given for clearness of understanding only, and no unnecessary limitations should be understood therefrom, as modifications will be obvious to those skilled in the art.

What is claimed is:

1. Apparatus for producing oil or gas from an offshore oil or gas well using a production platform near or above sea-level which is laterally and vertically displaceable by the sea and wind and which permits well workover from the production platform, comprising:

a. the following elements of a Christmas tree located at about the seafloor:

a first hydraulic connector joined to the wellhead;

a lower master valve joined to the first hydraulic connector; and a second hydraulic connector joined to the lower master valve;

b. a production tube extending from the second hydraulic connector to the platform and having a valve means accessible from the platform for oil or gas flow regulation, said production tube having a flexible portion which accommodates lateral and vertical movement of the production tube with the platform, and c. a production riser around the production tube and extending from the platform to near the seafloor.

2. Apparatus according to claim 1 in which an annulus tube extends from the second hydraulic connector to the platform, the annulus tube has a flexible portion which accommodates lateral and vertical movement of the annulus tube with the platform, and the annulus tube is in the production riser.

3. Apparatus according to claim 1 in which the platform is mounted on a buoyant articulated tower.

4. Apparatus acccording to claim 1 including a motion compensating means to stabilize the platform against movement and to tension the flexible portion of the production tube for well workover.

5. Apparatus according to claim 1 in which the valve means accessible from the platform is a dual master valve.

6. Apparatus according to claim 1 in which a vertical conduit extends upwardly from the valve means and is joined to a swab valve, and a tree cap closes the swab valve.

7. Apparatus according to claim 2 in which a vertical conduit extends upwardly from the valve means and is joined to a swab valve, and a tree cap closes the swab valve.

8. Apparatus according to claim 1 including a seafloor template having guide posts and well penetration holes, a buoyant articulated vertical tower supporting the platform, and means articulately joining the tower lower end to the template.

9. Apparatus according to claim 8 in which the tower has a guide rail and means joins the production riser to the guide rail.

* * * * *